US005670214A

United States Patent [19]

Saito et al.

[11] Patent Number: 5,670,214

[45] Date of Patent: Sep. 23, 1997

[54] METHOD FOR COATING A THIN LAYER ON A SUBSTRATE HAVING A ROUGH SURFACE

[75] Inventors: Atsushi Saito; Ichiro Miyagawa, both of Hino, Japan

[73] Assignee: Konica Corporation, Japan

[21] Appl. No.: 569,657

[22] Filed: Dec. 8, 1995

[30] Foreign Application Priority Data

Dec. 16, 1994 [JP] Japan ..... 6-313317

[51] Int. Cl.[6] ..... B05D 1/26

[52] U.S. Cl. ..... 427/356; 427/358; 427/402; 427/420; 118/410; 118/411

[58] Field of Search ..... 427/356, 358, 427/402, 420; 118/410, 411

[56] References Cited

U.S. PATENT DOCUMENTS 5,105,760 4/1992 Takahashi ..... 427/356
5,306,523 4/1994 Shibata ..... 427/356

FOREIGN PATENT DOCUMENTS 3434240 4/1985 Germany .

*Primary Examiner*—Katherine A. Bareford
*Attorney, Agent, or Firm*—Jordan B. Bierman; Bierman, Muserlian and Lucas LLP

[57] ABSTRACT

Disclosed is a method of coating a substrate having a center-line average roughness Ra of not less than 0.3 comprising steps of:

(a) conveying said substrate, and (b) coating said substrate while conveying said substrate with a coating solution under a coating condition defined by a capillary number Ca represented by Formula 1, wherein said capillary number Ca satisfies an inequality represented by Formula 2:

$$Ca = \mu \cdot U/\sigma \qquad \text{Formula 1}$$

$$Ca \leqq 0.3 \qquad \text{Formula 2}$$

wherein U represents a substrate conveyance speed in terms of cm/sec, μ represents a viscosity of said coating solution in terms of dyn-sec/cm$^2$, and σ represents a surface tension of said coating solution in terms of dyn/cm.

11 Claims, 3 Drawing Sheets

METHOD FOR COATING A THIN LAYER ON A SUBSTRATE HAVING A ROUGH SURFACE

FIELD OF THE INVENTION

The present invention relates to a coating method, in which a thin coating layer is provided by coating at high speed on a substrate of which surface is relatively rough.

BACKGROUND OF THE INVENTION

Conventionally, many patent applications, including, for example, U.S. Pat. Nos. 2,681,294 and 2,761,791 have been filed concerning bead coating method. In the bead coating method, thin film coating is performed by bringing the front end of the coater-lip at the head of an extrusion coater or a slide coater close to a substrate which is transported while being wound up around a back-up roller, making a clearance and forming a bead liquid receptor of the coating solution.

And in order to perform stable thinner coating at high speed, a method of reducing pressure at the back of the bead, has been employed.

However, although high-speed and stable coating by this method was possible on a substrate having flat surface, when the bead coating method is applied to a substrate of which surface is less flat, the bead behaves differently from the case of the coating on the flat surface, and thinner film coating becomes more difficult. This phenomenon is more remarkable in the high speed coating.

Heretofore, There is no effective prior art technology as to high speed coating on the surface of a substrate having less flatness and, accordingly, the object of the present invention is to provide a coating method, whereby high-speed and thin film coating on the surface of a substrate having less flatness can be achieved.

SUMMARY OF THE INVENTION

Item 1: A method of coating a substrate having a center-line average roughness Ra of not less than μ0.3 μm comprising steps of:

(a) conveying said substrate, and (b) coating said substrate while conveying said substrate with a coating solution under a coating condition defined by a capillary number Ca represented by Formula 1, wherein said capillary number Ca satisfies an inequality represented by Formula 2:

$$Ca = \mu \cdot U/\sigma \qquad \text{Formula 1}$$

$$Ca \leqq 0.3 \qquad \text{Formula 2}$$

wherein U represents a substrate conveyance speed in terms of cm/sec. μ represents a viscosity of said coating solution in terms of dyn-sec/cm$^2$, and σ represents a surface tension of said coating solution in terms of dyn/cm.

Item 2: A method of coating for a substrate having a centerline average roughness Ra of not less than 0.3 μm comprising steps of:

(a) conveying said substrate, and (b) multilayer-coating simultaneously said substrate with at least two types of coating solutions comprising a first coating solution coated closer to said substrate, and a second coating solution, wherein said first coating solution is employed under a coating condition defined by a capillary number $Ca_1$ represented by Formula 3, wherein said capillary number Ca satisfies an inequality represented by Formula 4:

$$Ca_1 = \mu_1 \cdot U/\sigma_1 \qquad \text{Formula 3}$$

$$Ca_1 \leqq 0.3 \qquad \text{Formula 4}$$

wherein U represents a substrate conveyance speed in terms of cm/sec, $\mu_1$ represents a viscosity of said first coating solution in terms of dyn.sec/cm$^2$, and $\sigma_1$ represents a surface tension of said first coating solution in terms of dyn/cm.

Item 3: The method of item 2, wherein said surface tension of said first coating solution is not less than a surface tension of said second coating solution.

Item 4: The method of item 2, wherein said first coating solution is a first solvent containing a solid ingredient.

Item 5: The method of item 4, wherein said first solvent is the same as a second solvent contained in said second coating solution.

Item 6: The method of item 1, wherein said capillary number Ca is not more than 0.2.

Item 7: The method of item 2, wherein said capillary number Ca is not more than 0.2.

Figure 1:
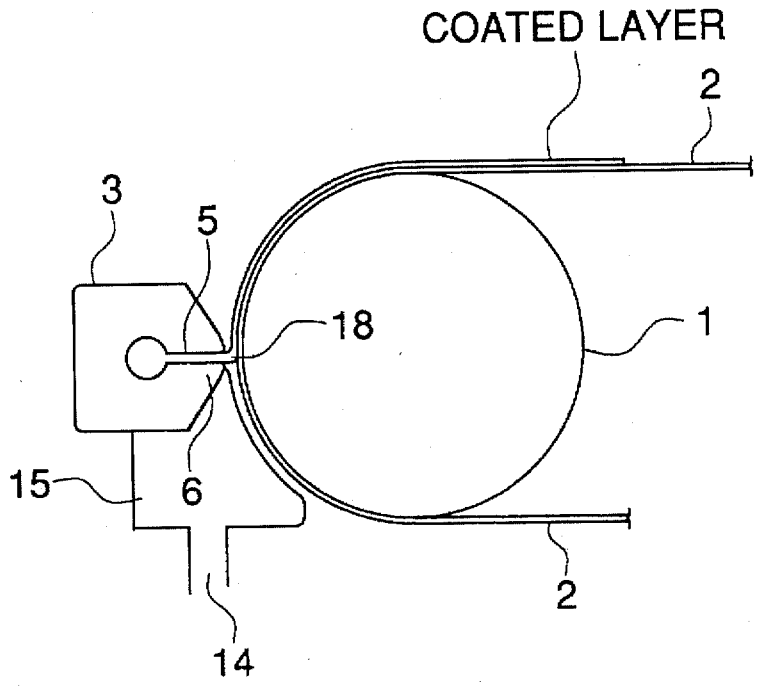
FIG. 1

Schematic drawing of a bead coater for single-layer coating employing extrusion coating method.

FIG. 2

Schematic drawing of a bead coater for double-layer coating employing extrusion coating method.

FIG. 3

Schematic drawing of a bead coater for single-layer coating employing slide coating method.

FIG. 4

Schematic drawing of a bead coater for double-layer coating employing slide coating method.

FIG. 5

Cross-sectional view of a coated material in the lateral direction.

FIG. 6

Cross-sectional view of a coated material in the lateral direction.

DETAILED DESCRIPTION OF THE INVENTION

The effect of the present invention can be obtained when the center-line average roughness Ra is not less than 0.3 μm, and when Ra is not less than 0.4 μm, the effect of the invention will become remarkable. In the region where high-speed coating of a thin layer has been considered to be impossible, it became understood from the experiments by the inventors of the present invention that high-speed coating became possible by reducing the viscosity μ dyne-sec/cm$^2$ and increasing the surface tension σ dyne/cm with the increase of the substrate conveyance speed U cm/sec to be more specific, it was found that the object of the present invention can be achieved when non-dimensional capillary number Ca represented by the following equation is satisfied;

$$0 < Ca = \mu U/\sigma \leqq 0.3$$

Further, it was found that more preferable result is obtainable when the above-mentioned Ca is made to satisfy the following equation.

$$0<Ca=\mu U/\sigma\leqq 0.2$$

Further, the object of the present invention can also be attained in a coating method, wherein at least two kinds of coating solutions are simultaneously coated on a substrate, the surface roughness of the substrate being similar to what described above, among the above-mentioned at least two types of coating solutions, physical property of the first coating solution to be coated adjacent to the substrate, wherein said method is carried out so that the physical property of a first coating solution to be coated adjacent to the substrate with non-dimensional capillary number Ca, the substrate conveyance speed U, viscosity of a first coating solution μ1P and the surface tension of said solution σ1 satisfy the following equation;

$$0<Ca_1=\mu_1.U/\sigma_1\leqq 0.3$$

Further, it was found that more preferable result is obtainable when the following equation is satisfied;

$$0<Ca_1=\mu_1.U/\sigma_1\leqq 0.2$$

As mentioned above, it became obvious that coating of a thin film, even if the film to be constructed is a single layer or a multi-layer structure, is possible by controlling physical properties of the coating solution to be coated adjacent to the substrate. However, in practice, viscosity rather than the surface tension may easily be controlled within wider range.

Further, in the method of multi layer coating at least two coating solutions simultaneously, it was found that there is a tendency for the upper coated layer to be shrunk easily when the directly coating solution directly coated on the substrate side has lower surface tension, and, accordingly, in order to realize even multi-layer coating, it is more preferable that a coating solution between those to be coated in the adjacent position, the coating solution directly coated on the substrate side has higher surface tension.

As mentioned above, it became obvious that coating of a thin film, even if the film to be constructed is of a single layer or a multi-layer structure, is possible by controlling physical properties of the coating solution to be coated adjacent to the substrate. However, in practice, it is often the case that the physical properties of the coating solution may not easily be controlled due to limitations in the view of properties or function, or in the view of drying condition. In such a case, a pre-coating is usually applied in order to level the surface of the substrate. However, it often leads to increase in drying load, and, moreover, in order to avoid it, pre-coating of an extremely thin layer becomes necessary, which accompanies considerable difficulty. Then, it is effective to add a solvent layer which does not contain a solid ingredient as the lower-most layer located adjacent to the substrate. The solvent layer evaporates during drying process and, accordingly, as the obtained coated film is approximately the same as desired the film. However, the solvent can remain in the lower-most layer as a residual solvent and can affect the properties of the coating film provided thereon. In such a case, it is also preferable to use the same solvent, which is added to an upper adjacent layer as the lower-most solvent layer. Thus, films having required coating film properties can be manufactured efficiently.

As for the center-line average roughness Ra, it is preferable that Ra is 0.3 to 1.5. In addition, the definition of the center-line average roughness Ra is clearly disclosed with JIS B 0601-1982 by The Japanese Industrial Standards .. Investigation Association.

As for the viscosity of the coating solution, the viscosity is measured by BL adapter-rotar of B-type viscosimeter manufactured by TOKIMEC Co. ltd.

As for the surface tension of the coating solution, the surface tension is measured by KYOWA SCIENTIFIC Co. ltd.

The substrate which is employed in the present invention usually means one made of paper, a plastic, a metal, etc., however, there is no specific limitation as to the material.

Also, there is no specific limitation concerning the method of coating, however, the present invention may preferably be applicable to a coating method, in which coated film thickness is determined only by the amount of the coating solution sent to the coater, represented by extrusion coating method and slide coating method.

FIGS. 1, FIG. 2, FIG. 3 and FIG. 4 respectively represent side views of coating apparatuses used in the examples of the present invention.

FIG. 1 represents a schematic view of a bead coater for single-layer coating employing extrusion coating method.

Figure 2:
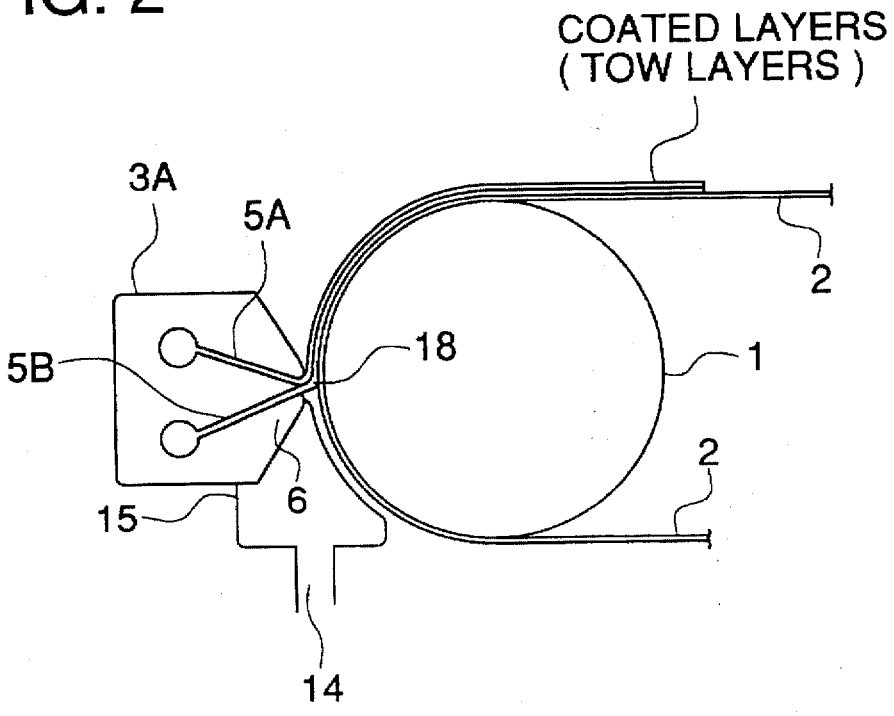

FIG. 2 illustrates a schematic view of a bead coater for double-layer coating employing extrusion coating method.

Figure 3:
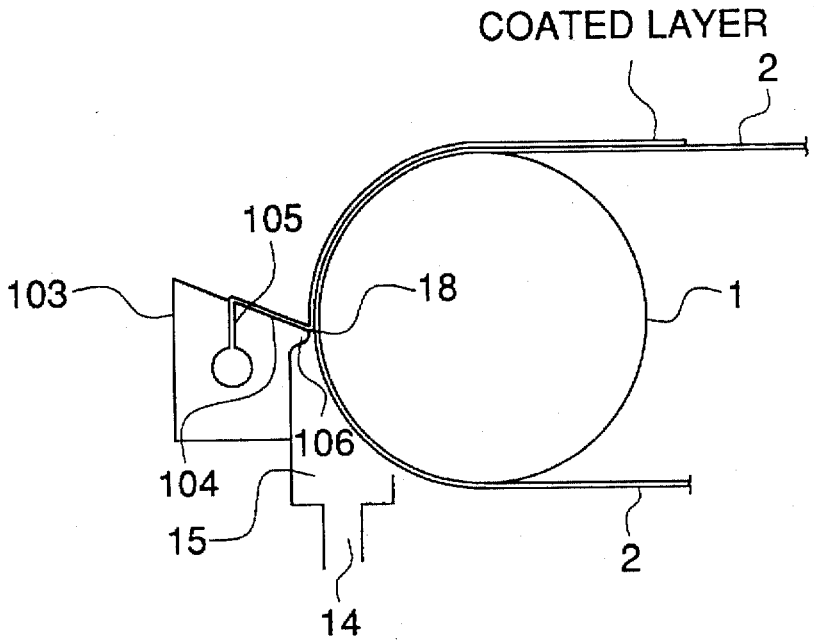

FIG. 3 illustrates a schematic view of a bead coater for single-layer coating employing slide coating method.

Figure 4:
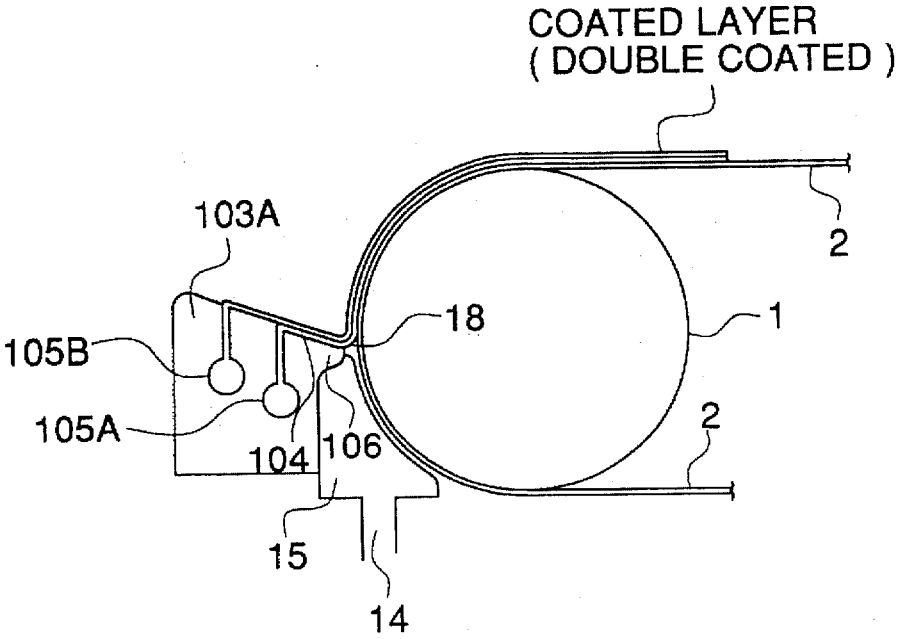

FIG. 4 illustrates a schematic view of a bead coater for double-layer coating employing slide coating method.

Coater head 3 of a bead coater for single-layer coating employing extrusion coating method shown in FIG. 1, is provided by bringing a coater-lip close to a substrate 2 with a clearance against a back-up roller 1, around which a substrate 2 is wound. The outlet of pushing-out route (slit) 5 is set in the neighborhood of said coater-lip 6. The coating solution which is pushed out by extrusion forms a bead 18 (liquid receptor), at the above-mentioned coater-lip 6 and is coated while being spread over the substrate which convey at a speed of U. For the purpose of stabilizing formation of the bead 18, a depressurization chamber 15 and a suction mouth 14 are provided.

In a coater head 3A of a bead coater for multi-layer coating employing extrusion coating method, shown in FIG. 2, pushing-out routes (slits) 5A and 5B are provided and simultaneous double-layer coating is carried out on the substrate, while forming a bead 18 at outlet of the coater lip 6. For the purpose of stabilizing formation of the bead 18, a depressurization chamber 15 and a suction mouth 14 are provided as in the case of single-layer coating. Multi-layer coating for simultaneously forming still more layers can be performed by providing three or more pushing-out paths (slits).

As a matter of course, it is possible to carry out single-layer coating by using only one of the plurality of pushing-out routes and closing the other paths.

Next, a coating apparatus employing slide coating method is explained.

In the coater head 103 of the coating apparatus, as shown in FIG. 3 which employs slide coating method, a coater-lip 106 is provided in the vicinity of a back-up roller 1, around which with the substrate 2 has been wound and transported with a clearance. A sliding plane 104 for the coating solution has been formed in the uphill slope of the coater-lip 106 and slit 105 is provided for supplying the coating solution, and coating is carried out on the substrate 2, which travels around the back-up roller at a speed U, while forming a bead (liquid receptor for the coating solution) at the above-mentioned coater-lip 106. For the purpose of stabilizing formation of the bead, a de-compression chamber 15 and suction mouth 14 are provided.

In a coater head 103A of a multi-layer slide coater employing slide coating method, which is shown in FIG. 4, a coater-lip 106 is provided in the vicinity of a back-up roller 1, around which with the substrate 2 has been wound and transported with a clearance. A sliding plane 104 for the coating solution has been formed in the uphill slope of the coater-lip 106 and pushing-out routes (slits) 105A and 105B for supplying the coating solutions are provided and double-layer coating is carried out on the substrate 2, while forming a bead 18 at outlet of the coater lip 106. For the purpose of stabilizing formation of the bead 18, a depressurization chamber 15 and a suction mouth 14 are provided as in the case of single-layer coating mentioned above. Multi-layer coating for simultaneously forming still more layers can be performed by providing three or more pushing-out routes (slits).

As a matter of course, it is possible to carry out single-layer coating by using only one of the plurality of pushing-out routes and closing the other routes.

Next, examples of the coating method carried out by the use of apparatus explained with reference to FIG. 1 and FIG. 2 are given below.

Hereinbelow, the present invention is further explained with reference to working examples, however, the scope of the present invention is not limited by them.

EXAMPLE A

By the use of a coater-head 3 for single-layer extrusion coating, regulating the clearance between the substrate 2 and the front edge of the coater-lip 6 to be 100 μm and reducing the pressure at the back of the bead 18 at 300 mmHg, coating on the two kinds of substrate, substrate-I and substrate-II was performed and marginal film thickness being capable of coating was measured. Results are shown in Table 1.

Substrate used in this example were as follows.

Substrate-I: polyethyleneterephthalate film having the center-line average roughness Ra of 0.2

Substrate-II: a Paper substrate having the center-line average roughness Ra of 0.5

TABLE 1

| No. | Substrate Conveyance Speed U [m/min.] | Viscosity μ [cP] | Surface Tension σ [dyne/cm] | Capillary Number Ca[–] | Marginal Film-Thickness against Substrate –I [μm] | Marginal Film-Thickness against Substrate –II [μm] |
|---|---|---|---|---|---|---|
| Comparative example 1 | 50 | 12 | 30 | 0.33 | 29 | 52 |
| Inventive example 1 | 50 | 12 | 35 | 0.29 | 29 | 32 |
| Inventive example 2 | 50 | 10 | 30 | 0.28 | 25 | 28 |
| Inventive example 3 | 50 | 7 | 30 | 0.19 | 20 | 20 |
| Comparative example 2 | 100 | 6 | 30 | 0.33 | 26 | 54 |
| Inventive example 4 | 100 | 4 | 30 | 0.22 | 20 | 23 |
| Inventive example 5 | 100 | 3 | 30 | 0.17 | 19 | 18 |

As is obvious from the results shown in Table 1, it is understood that in Examples 1, 2, 3, 4 and 5, coating on a substrate having rough surface became possible as well as coating on a substrate having smooth surface by making the capillary number Ca of not more than 0.3 when coating is carried out at a preferable substrate conveyance speed of 50 m/min. or 100 m/min. On the contrary, as shown in the results with respect to Comparative Examples 1 and 2, when the capillary number Ca exceeds 0.3, marginal thickness against Substrate-II became abnormally large. Further when the capillary number Cal is not more than 0.2, the marginal thickness against Substrate-II becomes still smaller, which is more preferable.

EXAMPLE B

By the use of a coater-head 3A having two pushing-out paths(slits) 5A and 5B for multi-layer extrusion coating as shown in FIG. 2, regulating the clearance between the substrate 2 and the front edge of the coater-lip 6 to be 100 μm and reducing the pressure at the back of the bead 18 at 300 mmHg, and under the condition that the layer thickness of the upperlayer side is regulated so as to have fixed layer thickness of 15 μm, multi-layer coating on the two kinds of substrate-I and substrate-II was performed while the capillary number Ca, so called, the substrate conveyance speed of U, the surface tension of σ and the viscosity of μ are respectively varied, and the marginal film thickness of the lower layer was measured. Obtained Results are shown in Table 2.

Substrate-I: polyethyieneterephthalate substrate having the center-line average roughness Ra of 0.2

Substrate-II: Polyethyleneterephthalate substrate having the center-line average roughness Ra of 0.5

TABLE 2

| No. | Substrate conveyance Speed U [m/min.] | Viscosity μ [cP] Lower Layer $\mu_1$ | Viscosity μ [cP] Upper Layer $\mu_2$ | Surface Tension σ [dyne/cm] Lower Layer $\sigma_1$ | Surface Tension σ [dyne/cm] Upper Layer $\sigma_2$ | Capillary Number Ca[−] Lower Layer $Ca_1$ | Capillary Number Ca[−] Upper Layer $Ca_2$ | Marginal Film-Thickness against Substrate −I [μm] | Marginal Film-Thickness against Substrate −II [μm] |
|---|---|---|---|---|---|---|---|---|---|
| Comparative example 3 | 50 | 12 | 12 | 30 | 25 | 0.33 | 0.40 | 19 | 40 |
| Inventive example 6 | 50 | 12 | 12 | 35 | 25 | 0.29 | 0.40 | 19 | 22 |
| Inventive example 7 | 50 | 10 | 12 | 30 | 25 | 0.28 | 0.40 | 15 | 17 |
| Inventive example 8 | 50 | 7 | 12 | 30 | 25 | 0.19 | 0.40 | 9 | 9 |
| Comparative example 4 | 100 | 6 | 6 | 30 | 25 | 0.33 | 0.40 | 16 | 44 |
| Inventive example 9 | 100 | 4 | 6 | 30 | 25 | 0.22 | 0.40 | 10 | 11 |
| Inventive example 10 | 100 | 3 | 6 | 30 | 25 | 0.17 | 0.40 | 9 | 9 |

As obvious from the results shown in Table 1, it is understood that in Examples 6, 7, 8, 9 and 10, coating on a substrate having rough surface became possible as well as coating on a substrate having smooth surface by making the capillary number of the lower-most layer adjacent to the substrate, $Ca_1$ to be less than 0.3, either when coating is carried out at a speed of 50 m/min. or 100 m/min, and even when the capillary number of the upper layer $Ca_2$ was regulated greater than 0.3. On the contrary, as shown in the results with respect to Comparative Examples 3 and 4, when the capillary number of the lower layer $Ca_1$ exceeds 0.3, marginal thickness of Substrate-II became abnormally large.

EXAMPLE C

Figure 6:
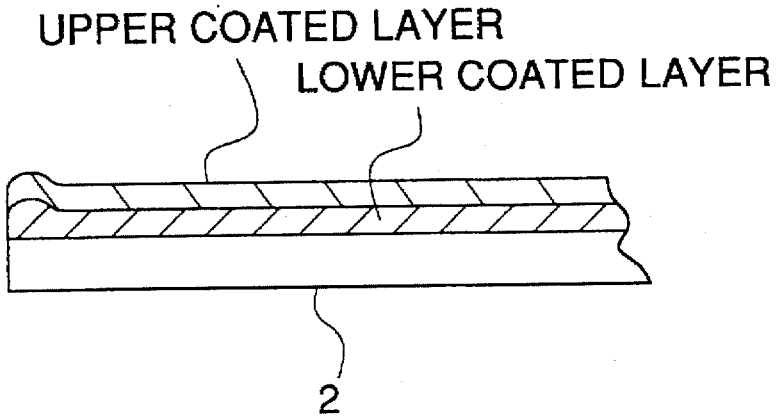

By the use of a coater-head 3A for multi-layer extrusion coating shown in FIG. 2, which has two pushing-out paths (slits) 5A and 5B, regulating the clearance between the substrate 2 and the front edge of the coater-lip 6 to be 100 μm and reducing the pressure at the back of the bead 18 at 300 mmHg, multi-layer coating on the two kinds of substrate-I and substrate-II was performed on the surface of a polyethyleneterephtrhalate substrate having Ra of 0.5, while varying the balance of the surface tension between the upper and the lower layer as shown in Table 3. Results are shown in Table 3.

edge portion of the lateral direction of the upper coating layer is remarkable. In Example 12, the relation between surface tension of the coating solutions for the lower layer and that for the upper layer is made vice versa to that in Example 1, and as shown in FIG. 6, which is a cross-sectional view of the coating in the lateral direction, the coated material shows stable and well-balanced condition. In this way, in the simultaneous multi-layer coating, it is desirable for the surface tension of the lower layer to have higher value than that of the upper layer adjacent thereto.

in Tables 1, 2 and 3 above, the substrate conveyance speed U, the viscosity μ, $\mu_1$, and $\mu_2$ and the surface tension σ, $\sigma_1$ and $\sigma_2$ are expressed in terms of [m/min.], [cP] and [dyne/cm], respectively. Capillary number Ca, $Ca_1$, and $Ca_2$ were calculated when μ, $\mu_1$, and $\mu_2$ are expressed in (P) and μ, $\mu_1$ and $\mu_2$ in dyne/cm.

What is claimed is:

1. A method of extrusion coating or slide coating a substrate comprising (a) conveying a substrate having a surface with a center-line average roughness Ra of not less than 0.3 μm, and (b) coating said surface during said conveying with a coating solution under conditions satisfying Formula 1 and Formula 2;

TABLE 3

| No. | Substrate Conveyance Speed U [m/min.] | Viscosity μ [cP] Lower Layer $\mu_1$ | Viscosity μ [cP] Upper Layer $\mu_2$ | Surface Tension σ [dyne/cm] Lower Layer $\sigma_1$ | Surface Tension σ [dyne/cm] Upper Layer $\sigma_2$ | Capillary Number Ca[−] Lower Layer $Ca_1$ | Capillary Number Ca[−] Upper Layer $Ca_2$ | Coated Film Thickness [μm] Lower Layer $h_1$ | Coated Film Thickness [μm] Upper Layer $h_2$ |
|---|---|---|---|---|---|---|---|---|---|
| Inventive example 11 | 100 | 3 | 6 | 25 | 30 | 0.20 | 0.33 | 10 | 15 |
| Inventive example 12 | 100 | 3 | 6 | 30 | 25 | 0.17 | 0.40 | 10 | 15 |

Figure 5:
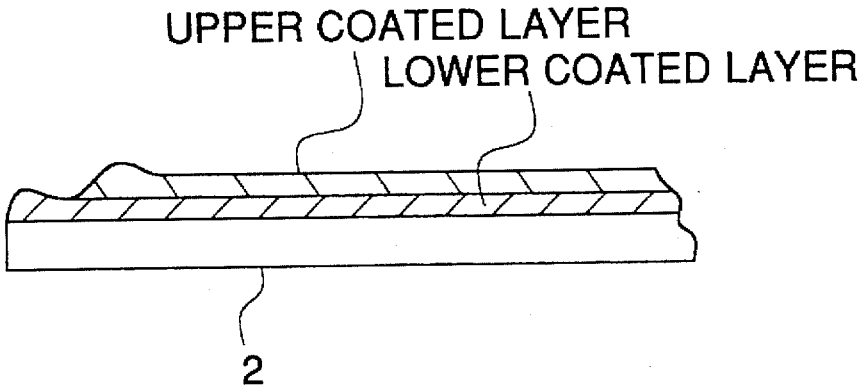

In Table 3, the surface tension of the coating solution for the lower layer 61 is smaller than $\sigma_2$ of the coating solution for the upper layer and, as shown in FIG. 5, shrinkage at the

| Formula 1 | Formula 2 |
|---|---|
| $Ca = \mu \cdot U/\sigma$ | $Ca \leqq 0.3$ |

wherein Ca is a capillary number, U represents a substrate conveyance speed in cm/sec, μ represents a viscosity of said coating solution in dyn-sec/cm$^2$, and σ is a surface tension of said coating solution in dyn/cm.

2. The method of claim 1 comprising supporting a back surface of said substrate.

3. The method of claim 2 wherein said substrate is supported by a back-up roller.

4. The method of claim 1, wherein said capillary number Ca is not more than 0.2.

5. The method of claim 1 comprising multilayer-coating simultaneously said surface with at least two coating solutions comprising a first coating solution coated closer to said substrate, and a second coating solution coated further from said substrate, wherein said first coating solution is employed under coating conditions wherein said capillary number Ca satisfies said Formula 1 and said Formula 2 wherein μ represents a viscosity of said first coating solution in dyn.sec/cm$^2$, and σ, represents a surface tension of said first coating solution in dyn/cm.

6. The method of claim 5 comprising supporting a back surface of said substrate.

7. The method of claim 6 wherein said substrate is supported by a back-up roller.

8. The method of claim 5, wherein said Surface tension of said first coating solution is not less than a surface tension of said second coating solution.

9. The method of claim 5, wherein said first coating solution is a first solvent containing a solid ingredient.

10. The method of claim 9, wherein said first solvent is the same as a second solvent contained in said second coating solution.

11. The method of claim 5, wherein said capillary number $Ca_1$ is not more than 0.2.

* * * * *